US007693448B1

(12) United States Patent
Lenahan

(10) Patent No.: US 7,693,448 B1
(45) Date of Patent: Apr. 6, 2010

(54) ANGLED SEAL FOR LASER TONER CARTRIDGE HOPPER

(75) Inventor: Scott Lenahan, Castaic, CA (US)

(73) Assignee: Wazana Brothers International, Inc., Van Nuys, CA (US)

( * ) Notice: Subject to any disclaimer, the term of this patent is extended or adjusted under 35 U.S.C. 154(b) by 0 days.

(21) Appl. No.: 12/479,628

(22) Filed: Jun. 5, 2009

(51) Int. Cl.
*G03G 15/08* (2006.01)
*G03G 15/00* (2006.01)

(52) U.S. Cl. ..... 399/106; 399/109

(58) Field of Classification Search ..... 399/102–106, 399/109
See application file for complete search history.

(56) References Cited

U.S. PATENT DOCUMENTS 5,027,156 A 6/1991 Kobayashi
6,350,503 B1 2/2002 Cheatham et al.
7,175,725 B2 2/2007 Chitouras
7,177,565 B1 2/2007 Miller
2003/0170045 A1 9/2003 Lewis et al.
2003/0205311 A1 11/2003 Chitouras
2004/0156650 A1 8/2004 Ziegelmuller et al.

FOREIGN PATENT DOCUMENTS

JP 59053868 A * 3/1984

* cited by examiner

*Primary Examiner*—David M Gray
*Assistant Examiner*—Joseph S Wong

(57) ABSTRACT

A remanufactured laser printer toner cartridge having a foam gasket seal with the transverse edge of the inner periphery extending from a longitudinal edge at an acute angle, preferably about 22 degrees, which angled edge prevents post testing excess toner from building up into a roll and jamming at the exit port as the remanufactured cartridge's pull strip is pulled when making the cartridge ready to install into the printer, and minimizes the likelihood that the gasket will be pulled off of the cartridge hopper section and jam the pull seal exit port as the pull seal is removed from the cartridge.

18 Claims, 8 Drawing Sheets

PRIOR ART

PRIOR ART

PRIOR ART

ANGLED SEAL FOR LASER TONER CARTRIDGE HOPPER

FIELD OF INVENTION

The present application is directed to the field of repair, refurbishment and remanufacture of laser printer toner cartridges, and in particular to a laser printer toner cartridge hopper gasket seal that prevents jamming of the cartridge by having an angled end portion positioned at the end of the gasket next to the pull seal exit slot or port of the cartridge.

BACKGROUND OF INVENTION

One problem with aftermarket laser printer toner cartridges sometimes occurs as the aftermarket cartridge is installed in the printer and made ready for printing by removing a strip seal that retains toner inside of the cartridge hopper during transportation from the manufacturer to the end user. The general problem is that the seal can jam and when it is jammed, it will not pull out of the cartridge. This seal, also known as the hopper gasket pull seal, has as its only purpose the sealing of the opening of the hopper tank for transporting to the end user without leaking toner into the shipping container. Once the seal is pulled out of the cartridge by the end user, the opening at the top of the toner hopper tank is uncovered, thus allowing toner to be transferred to the other components of the laser cartridge for printing.

One aspect or cause of the general jamming problem for conventional aftermarket toner cartridge gasket seals is that the pull seal does not always release, or lift up off completely from the opening on the hopper tank gasket. Then, rather than the pull seal lifting off of the gasket, the pull seal remains adhered to the gasket and the combined seal and gasket then lift off of the cartridge hopper to which the gasket is adhered. When that happens then they cause a jam at the pull seal exit port, resulting in the remanufactured laser toner cartridge to be classified as defective. Another aspect or cause of the general jamming problem for conventional aftermarket toner cartridges gasket seals is caused by the build up on top of the pull seal of excess toner from post testing as the pull seal is pulled out of the cartridge. This excess toner builds up and forms a tiny roll on the top of pull seal strip, and by the time the roll and pull strip are near the pull seal exit port of the cartridge, their combined diameter is sufficient to cause a jam at the exit port.

An original equipment manufactured (OEM) cartridge will typical not have this general problem because the pull seal is directly adhered to the toner hopper tank in the OEM manufacturing process. However, in rebuilding or remanufacturing aftermarket toner cartridges, the hopper tank is split into two sections, and then, during the remanufacturing process, the two sections are pressed and held together, typically by welding, or by a manual means, such as by clips, as described in U.S. Pat. No. 6,577,830. During the remanufacturing process the laser printer toner cartridge is cleaned and re-assembled, with new components and new toner charged into the hopper tank. As is known, the resulting remanufactured cartridge can have slight differences in dimensions as related to OEM specifications, and differences exist in aftermarket toner cartridge hopper tank gasket seals and pull strips. To account for some of these differences and in-order to maintain a good seal at the toner cartridge hopper opening, a remanufactured toner cartridge incorporates a gasket seal, and the hopper tank gasket seal is typically made from foam, so that a good seal of the hopper can be formed by the gasket and the pull strip. Once the remanufactured cartridge has been sent to an end user and is installed in the printer, ready for use, the pull strip is pulled off of the gasket and out of the toner cartridge to activate the laser toner cartridge for printing. This pulling of the pull seal is when there is a chance that the hopper pull strip will not always release from the hopper tank gasket seal as planned.

It has been discovered that in many instances the reason the hopper tank gasket pull strip does not release from the gasket and thus causes jamming, is due to mechanical reasons. One of the most common reasons for jamming is that the foam gasket is pulled up along with the pull strip and then the gasket and/or the pull strip jam the pull strip exit slot as the pull strip is being pulled out of the laser printer toner cartridge. Another common reason is that "post test toner" that remains after testing the re-manufactured cartridge upon assembly in the factory, curls up with the pull strip as the pull strip is moving along toward the exit slot, and forms a roll or plug of toner that causes jamming at the pull seal exit slot. As this excess toner curls up it forms into a log shape on the top of the pull strip, and it will then lock up along with the pull seal at the beginning of the pull seal exit slot, thus preventing any further pulling of the pull strip and causing the cartridge to be unusable. This phenomenon is known in the industry as the "cigar effect", due to the fact that the excess toner literally looks like a tiny cigar when is it is curled up and is at the pull seal exit slot. The cigar effect causes jamming due to a lack of clearance through the exit slot. In this situation the diameter of the combined cigar shaped toner plug and the surrounding pull seal strip is greater than the width of the pull seal exit slot. As a result the pull seal strip cannot be pulled through the slot and removed from the cartridge.

SUMMARY OF THE INVENTION

A remanufactured toner cartridge is provided with gasket that has an angled end on its inner periphery at the end adjacent the cartridge pull seal exit port. The combined gasket and the pull seal that is adhered to the gasket is an angled gasket seal that will not jam at the exit port and will not cause the breakage of the pull strip. This is due to the angle of the gasket located at the end of the gasket next to the exit port and where the pull strip is hot melted to the gasket. Because of the angled edge of the gasket, the end of the pull strip at the leading edge of the angle is released first, and then the rest of the end of the pull strip is released along the angled edge of the gasket. By having the leading edge of the pull strip released before the rest of the pull strip two advantageous results occur. First, the chances of the gasket pulling up off of the cartridge is reduced to eliminated because at any one instance the total pulling force exerted on the gasket is relatively small. Second, the excess toner can drop into the hopper and will not build up into a roll because as the angled edge is exposed by the pull seal releasing along that edge a path for the excess toner to drop into the toner hopper is formed, and no roll of excess toner is built up near the cartridge pull seal exit port. Thus, the excess toner will not cause jamming of the pull seal as it is pulled from the tank through the exit seal port slot, and the pull seal will not pull up the gasket from the hopper.

A laser printer toner cartridge with a toner hopper gasket seal having a foam gasket, an angled portion at the end of the gasket positioned at the cartridge pull seal exit port and a pull seal hot melted to the gasket prevents or minimizes jamming of the pull seal as it is pulled out of the toner cartridge. Angled seals as described herein will not jam in the cartridge, and will not break when the pull seal strip is pulled. This is because the angle between the longitudinal and transverse edges of gasket at the end of the gasket at the pull seal exit port is not 90°.

Rather that angle is greater than 0° and less than 90°, and is preferably about 22°. Conventional aftermarket toner cartridge gasket seals have straight, 90° angles at those edges, and it has been discovered that this 90° angle can cause the above mentioned problem of jamming and breakage upon pulling the pull strip from the laser toner cartridge prior to its operation. OEM pull seal gaskets do not have the above mentioned problem, because the OEM pull seal strip is adhered directly to the plastic toner cartridge hopper tank.

The angled hopper tank gasket pull seal overcomes the two problems mentioned; the foam gasket peeling up with the pull seal, thus jamming at the exit seal slot, and the 'Cigar effect", which is due to a roll of toner that is rolling up as the pull strip is being removed from the top surface of the foam seal, thus, again jamming at the exit seal slot. The problem of the foam gasket being pulled up while the pull strip is being removed is eliminated with the gasket having an angle formed at the end of the gasket just before the exit seal slot. This is accomplished with the end of the seal having an angle formed into the foam gasket at the end, closest to the exit seal slot, where the laser toner cartridge pull strip is pulled to activate the cartridge for printing purposes. The angled hopper gasket, or angled shape to the gasket, will prevent the foam from lifting and jamming at the exit slot by giving the pull strip very little weld for the pull strip to grab onto as the pull strip is being pulled from the cartridge. The heat weld location is the key on to how the angled gasket eliminates the possibility of the hopper tank foam gasket being pulled up with the seal. The weld is how the pull strip is attached to the foam gasket. The pull strip is welded around the perimeter of the foam gasket and is what seals the gasket, until the strip is pulled out of the cartridge by the end user. In previous aftermarket designs, the weld around the gasket is shaped in a rectangular form or ninety degrees from the weld perpendicular to the weld in question, which results in more surface area on the foam being pulled on the foam gasket, as the pull strip is being removed from the toner cartridge. The pull strip is being pulled off the weld and away from the foam gasket and towards the exit seal slot. If the foam lifts off the hopper tank surface as the pull strip is being pulled from the gasket, it will jam at the exit seal slot due to a clearance issue. The foam gasket is thicker than the slot that the pull strip, with foam, is trying to slide through. Having an extreme angle cut or formed into the foam gasket will only allow a small amount of surface area to be pulled upon by the welded gasket, thus giving the strip an easy exit out the exit slot without the worry of foam gasket material coming with it, thus jamming at the slot. In other words, there is less pull force being applied to the gasket as it is being removed.

The second reason the angled hopper tank gasket works to eliminate the jamming problem on aftermarket cartridges pertaining to pull seal failures is from the excess toner that is in the tank from a post testing procedure that is done after the toner cartridge has been remanufactured to assure its quality. What happens, in some cases, is when the pull strip is being pulled from the hopper tank foam gasket and tearing loose from the weld around the perimeter of the foam gasket, toner will gather and roll up with the pull seal creating a log of toner that has a larger diameter than that of the exit port, thus preventing the remaining portion of the pull seal from being removed causing a defective cartridge.

These and other embodiments, features, aspects, and advantages of the invention will become better understood with regard to the following description, appended claims and accompanying drawings.

BRIEF DESCRIPTION OF THE DRAWINGS

Reference symbols or names are used in the figures to indicate certain components, aspects or features shown therein. Reference symbols common to more than one figure indicate like components, aspects or features shown therein.

The foregoing aspects and the attendant advantages of the present invention will become more readily appreciated by reference to the following detailed description, when taken in conjunction with the accompanying drawings, wherein.

DETAILED DESCRIPTION

Figure 1:
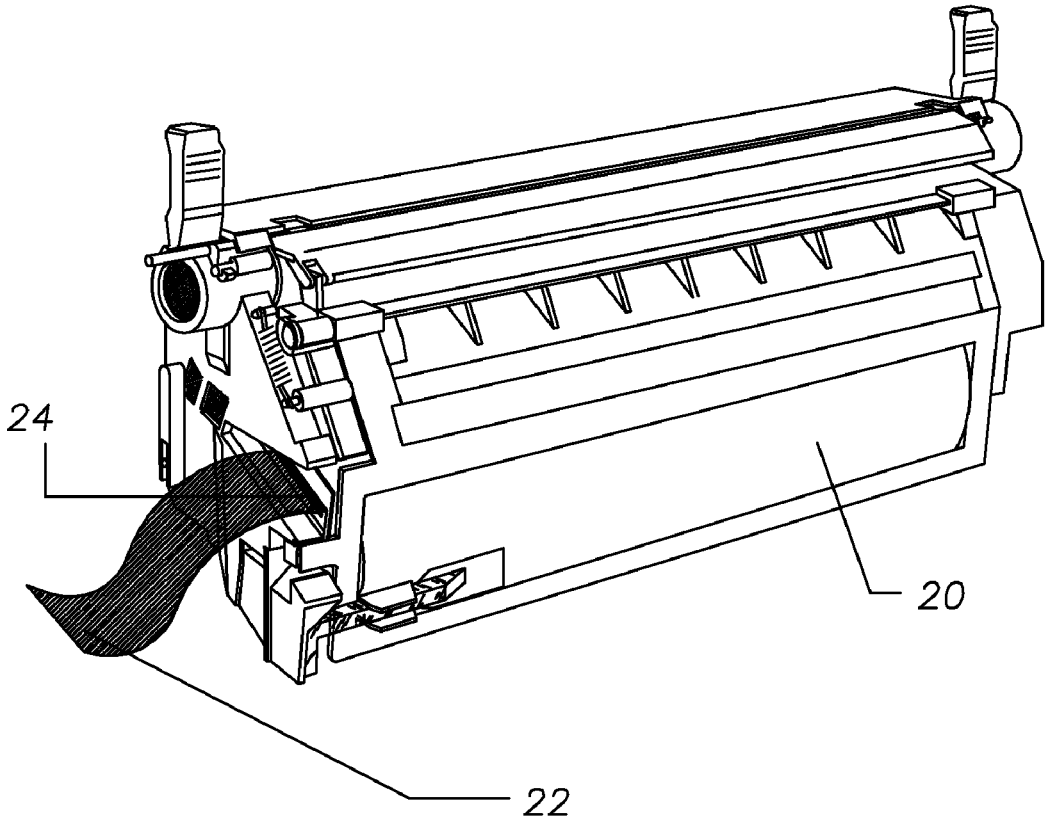
FIG. 1 is a perspective view of a conventional remanufactured toner cartridge having a gasket seal pull strip extending out of the exit seal.

With reference to FIGS. 1-8 embodiments of angled gasket seals for use in laser printer toner cartridges will be described. FIG. 1 shows a typical, conventional laser printer toner cartridge 20, as its toner hopper pull seal strip 22 is partially pulled out of the cartridge 20 for operation. The pull seal strip 22 exits at the end of the cartridge that has cartridge exit slot 24. Pulling the pull seal strip 22 out of the cartridge allows toner to be released from the toner hopper tank, as is well known.

Figure 2:
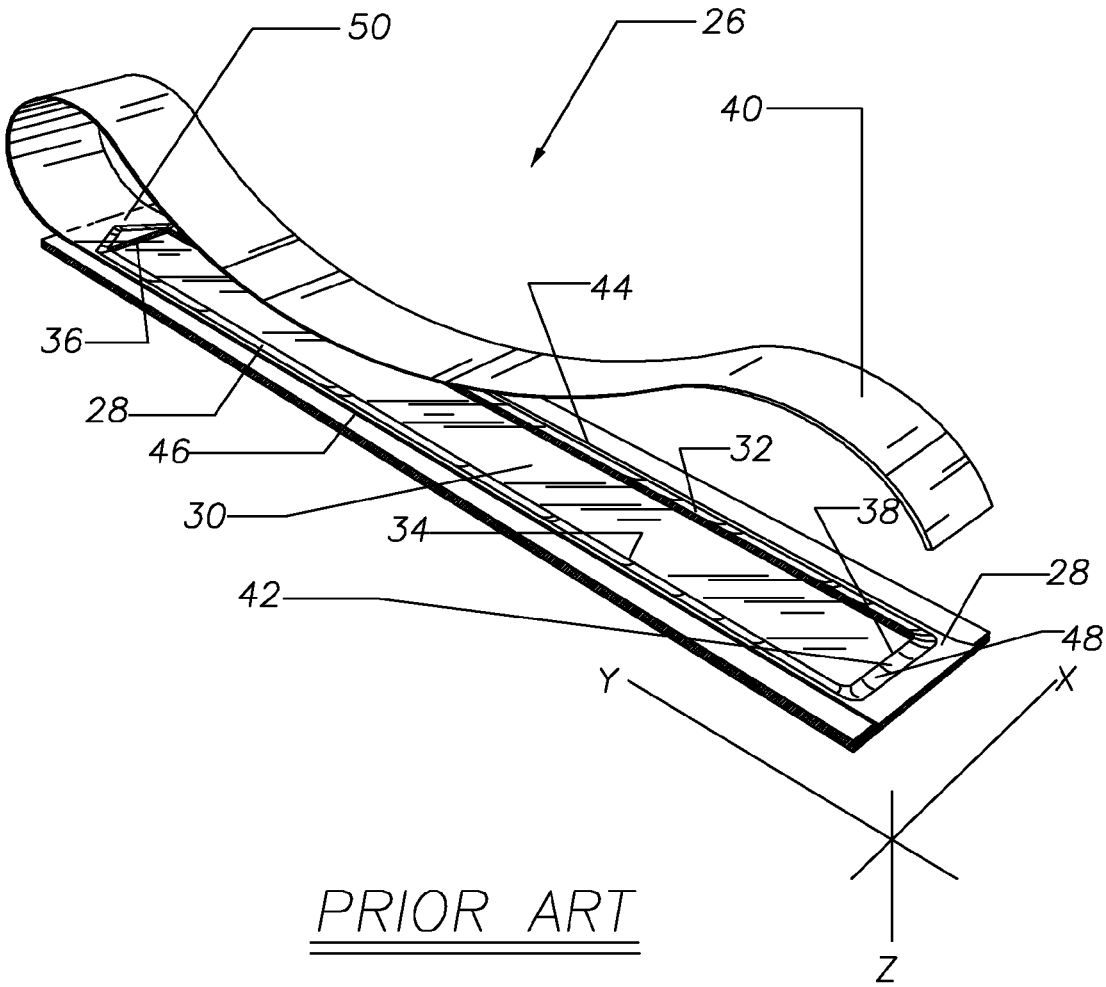
FIG. 2 is a perspective view of a conventional gasket seal of the FIG. 1 cartridge.

FIG. 2 illustrates a conventional rectangular shaped pull seal 26 used for remanufactured toner cartridges. Seal 26 includes foam gasket 28 that preferably has a rectangular outer periphery and a rectangular inner periphery with an opening 30 in its center, to permit transport of toner from the hopper to the cartridge roller section during printing operations. With reference to the axis shown in FIG. 2, the gasket length extends in a longitudinal direction Y, its width extends in transverse direction X and it has a thickness extending in direction Z. The inner peripheral edges are shown as first longitudinal edge 32, second longitudinal edge 34, first transverse edge 36 and second transverse edge 38. The four inner peripheral edges are at right angles at their joining corners. Overlying the gasket 28 is pull seal strip 40, preferably made of a polyester film or metalized polyester film, often referred to as Mylar film. One end 42 of the seal 26 is near the toner cartridge pull seal exit port or slot. The pull strip 40 is hot melted to the foam gasket at or near the inner periphery of the gasket, with a first longitudinal hot melt border shown at 44 and a second longitudinal hot melt border shown at 46. At the end 42 of the gasket hot melt border 48 is shown. At the end of the gasket opposite the cartridge pull seal exit port the pull seal is hot melted in the form of a relatively blunt point or arrowhead, as shown at 50 in FIG. 2. The hot melt adheres the pull strip to the gasket, forms a sealing border around the rectangular opening in the gasket and functions to seal the toner inside of the hopper during transport from the manufacturer to the end user. The hot melt border at the end 42 of the gasket has a shape generally conforming to the right angled edges of the inner periphery of the gasket. At the opposite end of the seal, the pointed hot melt pattern 50 facilitates the initial tearing away of the pull seal strip 40 from the gasket 28. The pull seal strip 40 is shown folded over on itself, in a position to be pulled.

Figure 3:
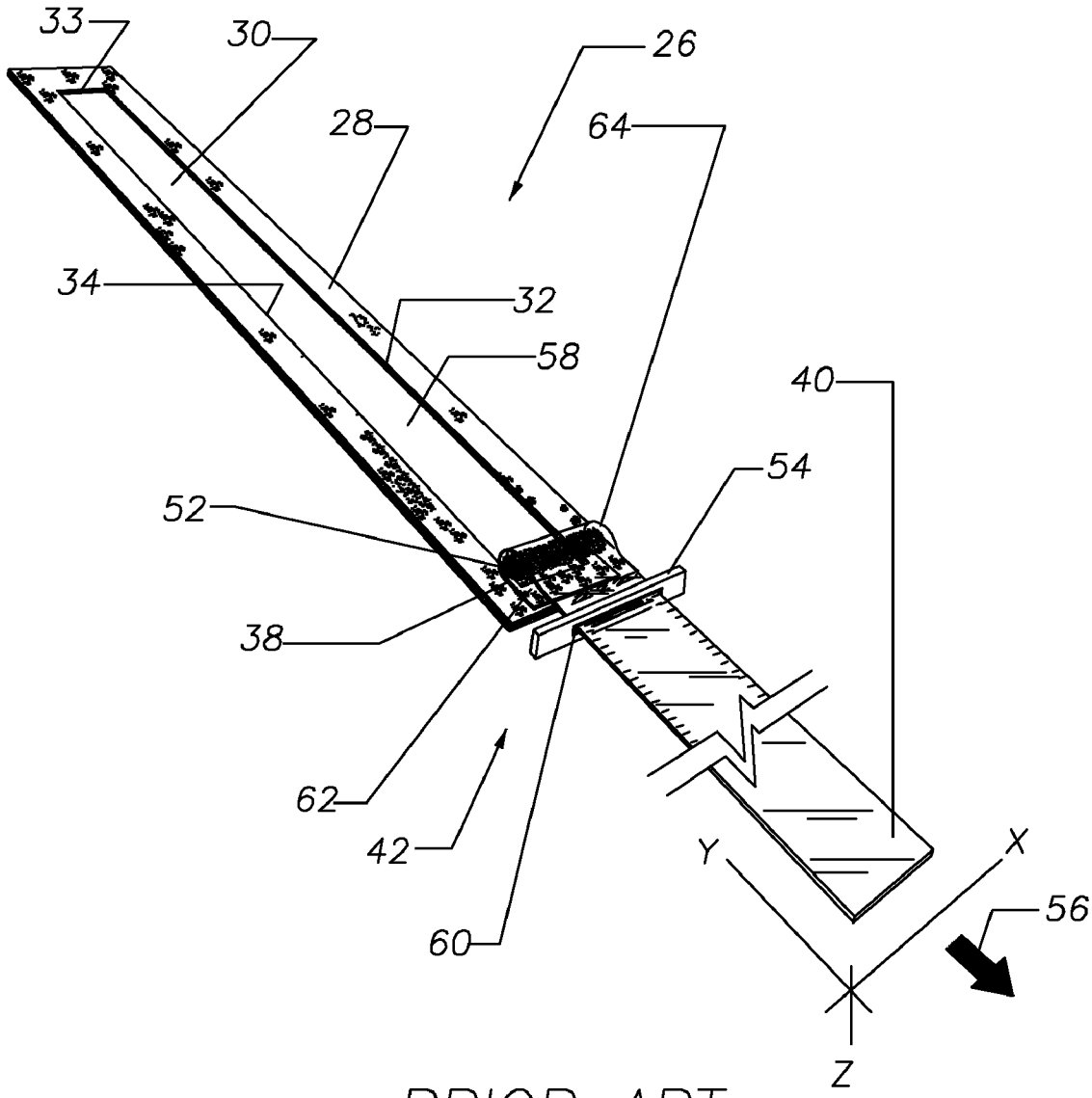
FIG. 3 is a perspective view of a conventional remanufactured gasket seal of FIG. 2 showing a roll of toner blocking removal of the pull strip from the cartridge.

Referring to FIG. 3 conventional seal 26 of FIG. 2 is shown at a point during removal of the pull seal strip 40 when the pull seal strip 40 has been almost completely pulled out of the cartridge, about to be jammed due to the presence of the cigar effect, i.e., a tiny roll of toner 52 that has formed on the top surface of the pull seal strip 40 as its unattached end is pulled out of the cartridge through the exit port 54 in the direction of arrow 56. In this instance jamming occurs due to the roll of toner 52 that prevents the pull seal strip 40 from exiting the cartridge through the seal strip exit port 54. The purpose of the seal strip exit port 54 is to keep the toner cartridge sealed after the toner hopper pull seal 40 has been peeled away from the toner hopper foam gasket 28. While the toner cartridge is in use inside of the printer, toner will be drawn from the toner hopper 20 through the opening shown at 58 of the foam gasket 28 and eventually to the paper from the laser printer. This opening at the interface of the hopper section and the roller section of the cartridge must remain sealed in order to prevent toner from leaking out of the cartridge.

The seal strip exit port 54 has a slot 60 that in turn has enough clearance to allow the pull strip 40, usually 2 to 5 mils in thickness to be removed by pulling it in the direction shown by arrow 56. As shown in FIG. 3 excess toner from the post testing that has developed into the roll or cigar shape 52, inside of the pull strip 40, will not be able to pass through the exit seal port slot 60. The pull seal 40 will jam at the opening or slot of the exit port 54, thus making the toner cartridge defective. As shown in FIG. 3 the cigar shaped roll 52 of the toner has built up at the right-angled corners where the first and second longitudinal edges 32, 34 meet the second transverse edge 38 of the conventional gasket 28, adjacent the hot seal border shown at 62. The thickness of this roll, together with the thickness of the two layers of pull seal 40 at location 64 has a combined thickness sufficient to jam at the opening 60 of the exit port 54.

Figure 4:
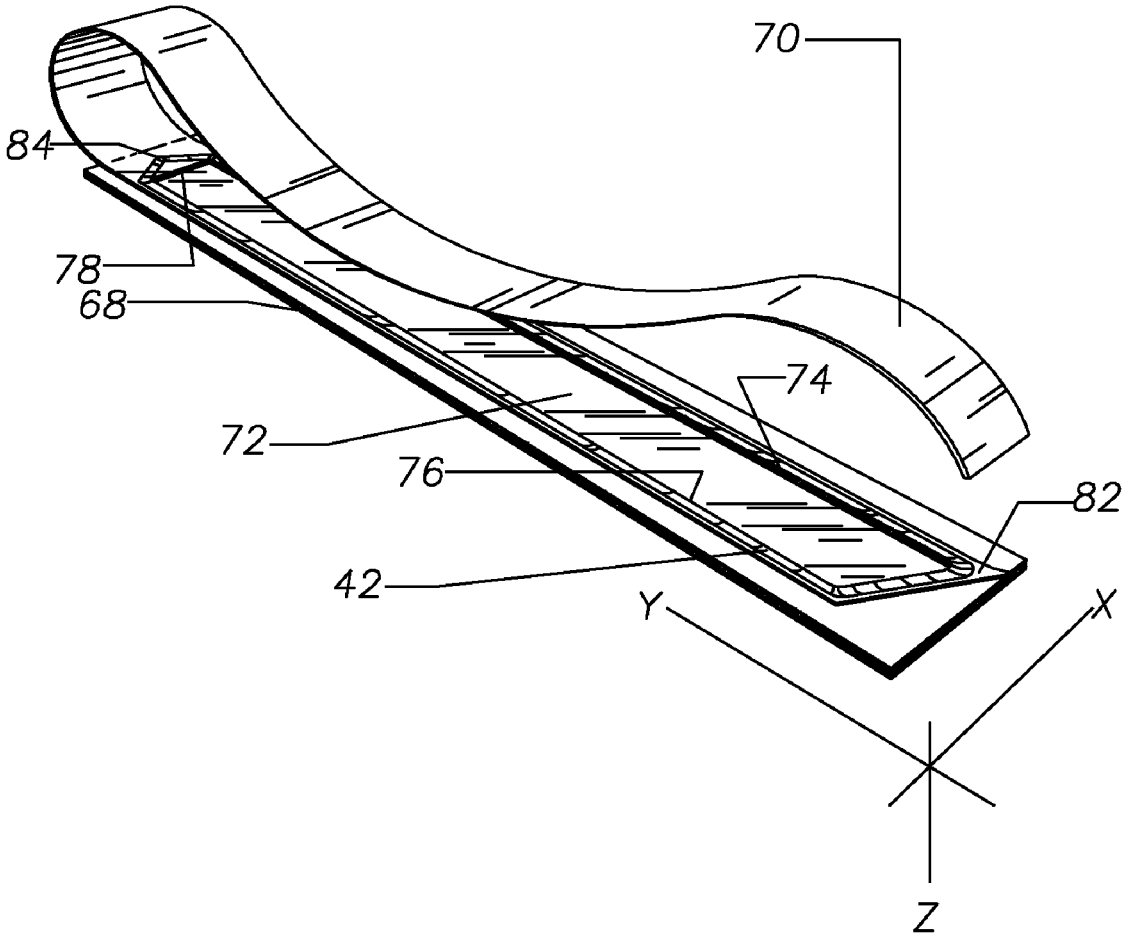
FIG. 4 is a perspective view of a preferred embodiment of an angled laser toner hopper gasket seal.

With reference to FIGS. 4-8 embodiments of angled toner cartridge seals will be described. FIG. 4 is a perspective view of a preferred embodiment of an angled gasket seal 66 that includes foam gasket 68 and a pull seal strip 70. The gasket 68 has an opening 72 in its center to permit through flow of toner during printer operation and the sides or edges of the inner periphery include a first longitudinal edge 74, a second longitudinal edge 76, a first transverse edge 78 and a second transverse edge 80. The angles formed by the longitudinal edges of the inner periphery with the second transverse edge are acute angles, rather than right angles as in the conventional gasket. While any acute angle is believed to be useful to address the problems identified above, the preferred angle Φ is about 22 degrees between the first longitudinal edge 74 and the second transverse edge 80. The pull seal strip 70 is heat sealed over the gasket opening, forms a border seal and has a pointed shape 84 adjacent the first transverse edge 78, as in the conventional gasket seal described above. The heat seal border is shown in FIG. 4.

Figure 5:
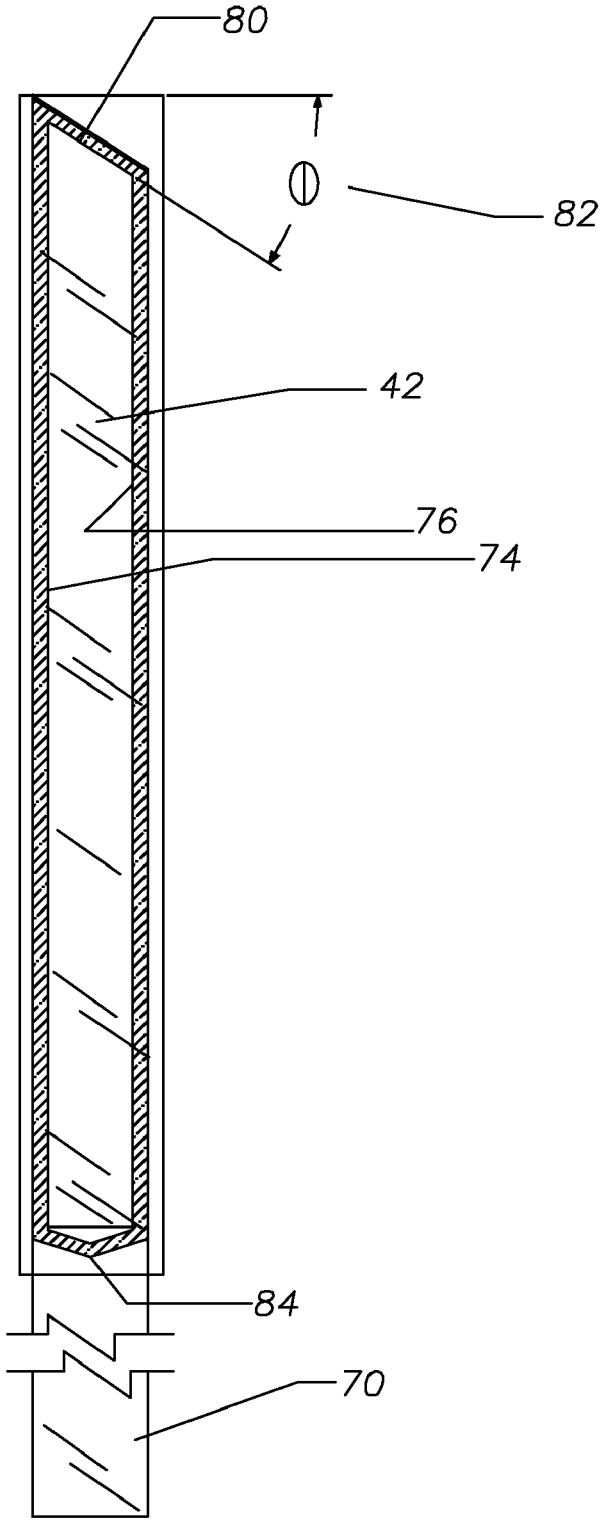
FIG. 5 is a top view of the FIG. 4 embodiment.

FIG. 5 is a top view of the FIG. 4 angled gasket seal 66. At the intersection of the first longitudinal edge 74 of the inner periphery of the gasket, and the second transverse edge 80 of the gasket acute angle Φ is shown at 82. While it is believed that various embodiments of the gasket seal having any angle greater than 0 degrees and less than 90 degrees will function to prevent jamming, an angle of about 22 degrees is preferred. The angle shown in FIGS. 4 and 5 is approximately 30 degrees.

Figure 6:
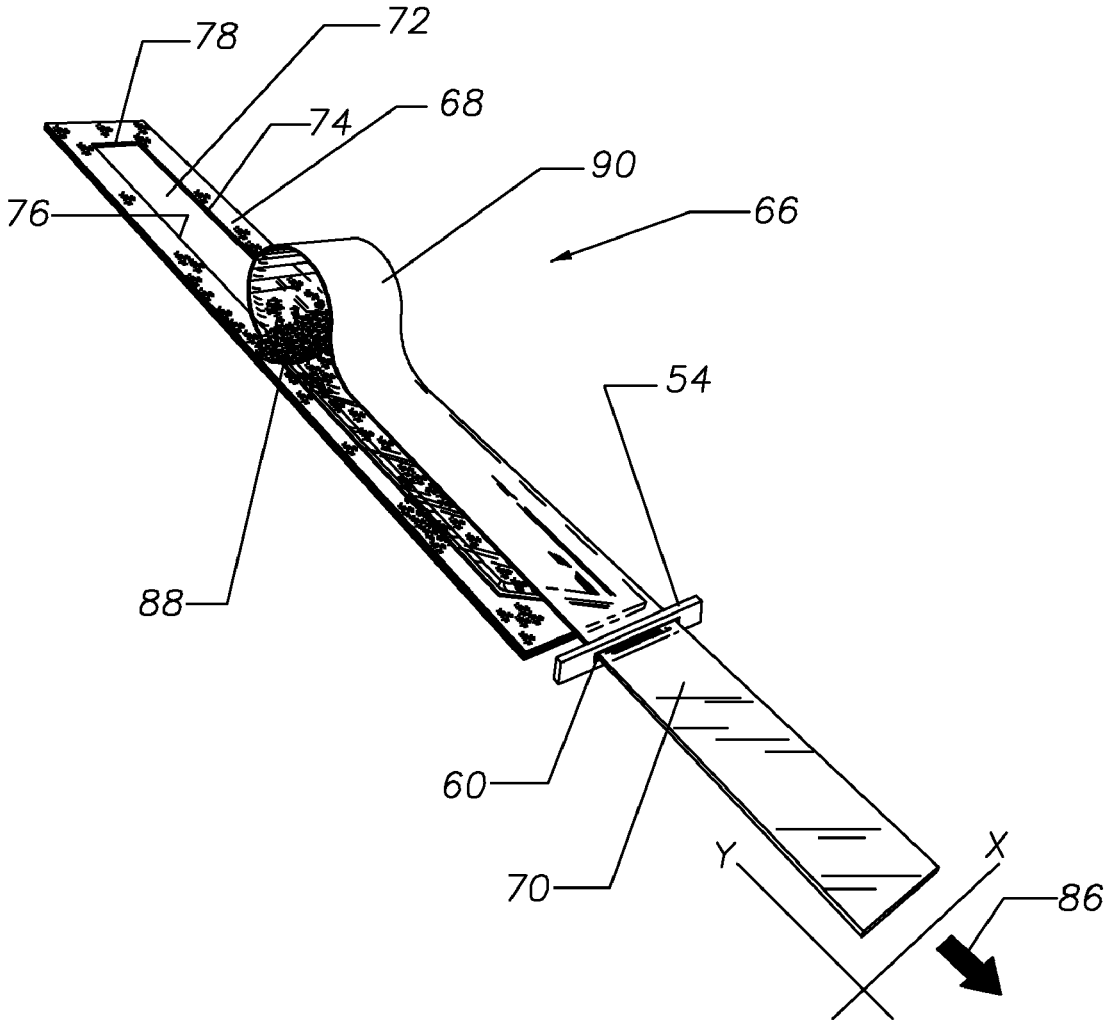
FIG. 6 is a perspective view of the FIG. 4 embodiment showing the seal strip partially removed from the gasket.

FIG. 6 further illustrates how, as the angled pull strip 70 is pulled in the direction of arrow 86 and thus off of the angled gasket 68, toner begins to build up along the top surface of the pull strip 70. The toner build up is shown at 88 and a loop of the pull strip 70 is shown at 90.

Figure 7:
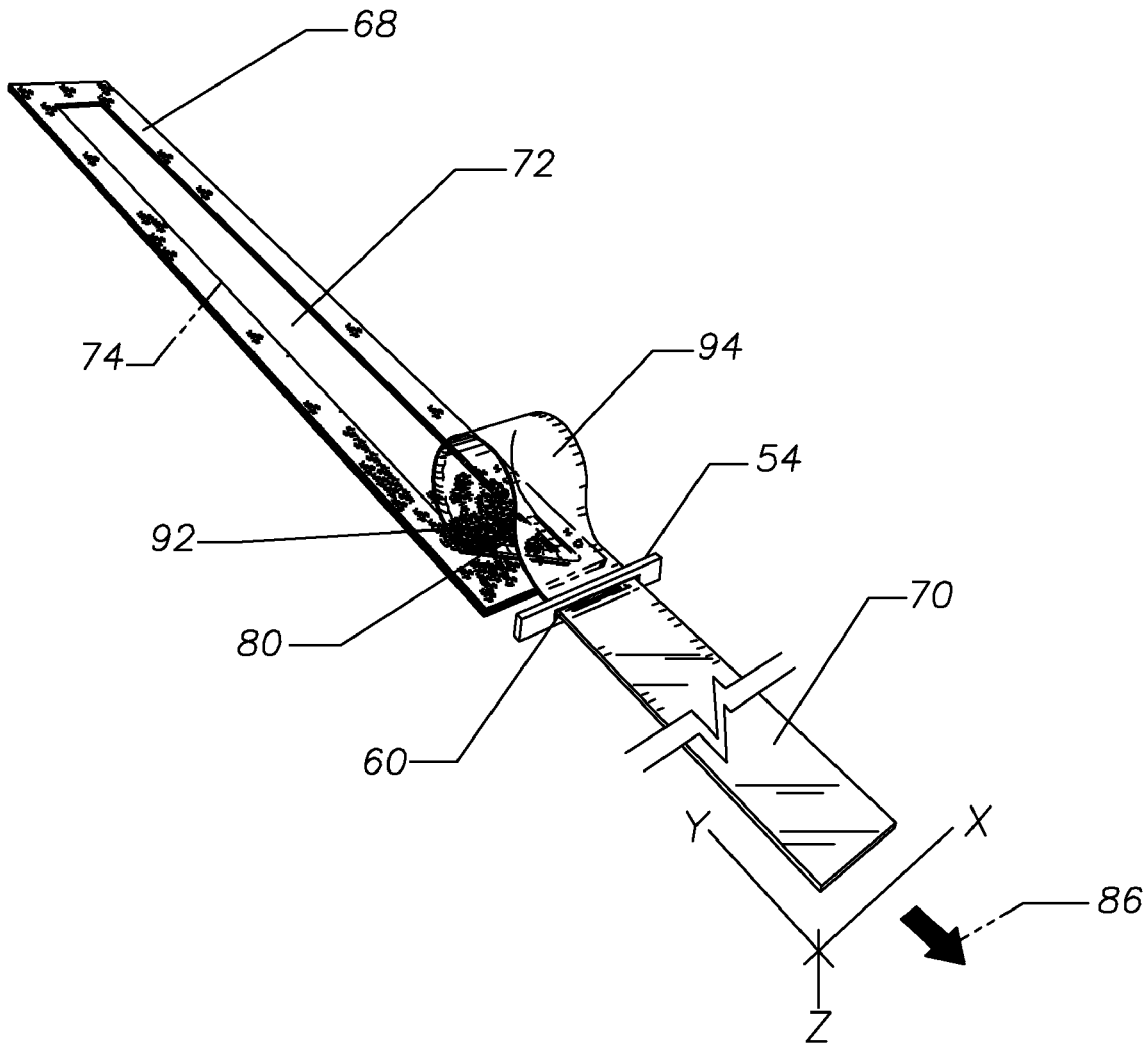
FIG. 7 is a perspective view of the FIG. 4 embodiment, showing the seal strip further removed than is shown in FIG. 6; and, FIG. 8 is a perspective view of the FIG. 4 embodiment, showing the seal strip further removed than is shown in FIG. 7.

FIG. 7 is a perspective view of the FIG. 4 preferred embodiment seal and at point during removal of the pull strip after that shown in FIG. 6 and close to the point when the end of the pull strip 70 is close to the intersection of the first longitudinal edge 74 and the second transverse edge 80 of the gasket 68. At this point the excess toner build up 92 has increased in comparison to that shown in FIG. 4, and positioned to jam the exit port 54 at opening 60. During pulling the pull seal strip 70 forms a loop, shown at 94, above the gathering toner that has reached or is about to reach the position of the angled second transverse edge 80 of the gasket 68. The toner gathered as shown in FIG. 7 would likely cause a jam at port 54, except for the presence and functioning of angled seal edge 80.

Figure 8:
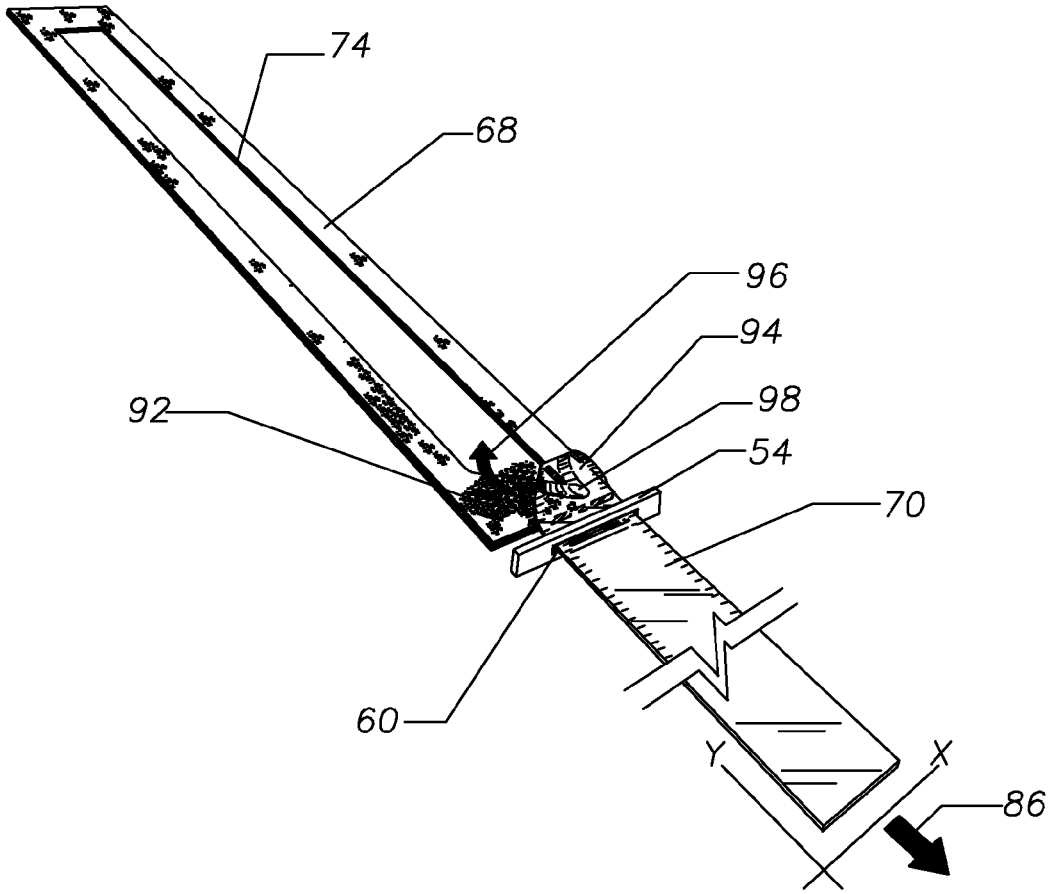

FIG. 8 illustrates the angled end 80 of the seal gasket providing a way for the excess toner to by-pass the exit port as the pull strip 70 is pulled off of the gasket 68. In this context the term "by-pass" means that the toner is permitted to fall through the opening into the hopper as the seal strip 70 at the corner of the first longitudinal edge 74 and the second transverse edge 80 is lifted up off of the gasket. In this way the toner is not formed into a plug or roll at the end of the gasket, but rather falls through the opening and into the hopper as the end of the seal is progressively broken by lifting it off of the end of the gasket, as shown by arrow 96.

The angled seal as describe above also reduces to eliminates jamming due to the gasket lifting up off of the toner cartridge in some instances. It is believed that an angled seal as described and shown herein works for its intended purpose for at lease two reasons. The first reason relates to the gasket lifting problem, and is that the lifting force applied at any given instant to the gasket 68 as the pull seal advances over the acute angled transverse edge 80 is much less than is the lifting force applied to the right angled transverse edge 48 of the conventional gasket during removal of the pull seal in the conventional gasket seal. At any given instant when the lifting force is applied to lift the pull seal and break the hot melt seal along the angled transverse edge of the gasket, the force applied is split into two directions or into two force vectors, one component in the direction of arrow 46 and the other component perpendicular to that direction. Further more, the force applied is applied from a much small surface area of the seal strip and thus the total applied force is also less. Thus, at any instant significantly less force pulls the hot seal up off of the angled gasket transverse edge at the end near the exit port than the pulling force applied when a conventional, right-angled gasket is used. The lifting force applied at any instant along this edge is minimized, thus, reducing the chance that the gasket can be pulled up and jammed at the exit port slot 54. The second reason is that as the pull strip is removed from the angled gasket, it provides a path for the excess toner on the top of the pull seal to pass into the hopper tank, thus, preventing jamming at the exit port slot 54 due to the cigar effect. In contrast the conventional gasket as shown in FIGS. 1-3 provides nowhere for the toner to go, thus resulting in cigar-effect jams at the exit port when the pull seal is removed.

Although specific embodiments of the invention have been described, various modifications, alterations, alternative constructions, and equivalents are also encompassed within the scope of the invention.

The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

What is claimed is:

1. A remanufactured laser printer toner cartridge comprising:

a hopper section having a rectangular opening;

a roller section operatively connected to the hopper section;

a gasket having a four-sided opening, positioned over the hopper section rectangular opening and adhered to the hopper section;

the gasket opening having a first longitudinal edge, a second longitudinal edge, a first transverse edge and a second transverse edge;

the gasket second transverse edge forming a first angle with the gasket first longitudinal edge, the first angle being an acute angle;

the gasket second transverse edge forming a second angle with the gasket second longitudinal edge; and, a strip of film extending over the four-sided opening and adhered to the gasket.

2. The remanufactured cartridge of claim 1, wherein said film is a polyester film.

3. The remanufactured cartridge of claim 1, wherein the first angle is about 30 degrees.

4. The remanufactured cartridge of claim 1, wherein the second angle is about 30 degrees.

5. The remanufactured cartridge of claim 1, wherein the first angle is about 22 degrees.

6. The remanufactured cartridge of claim 1, wherein the second angle is about 22 degrees.

7. A gasket seal for use in a remanufacturing a laser printer toner cartridge including:

a foam gasket having a four-sided opening;

the gasket opening having a first longitudinal edge, a second longitudinal edge, a first transverse edge and a second transverse edge;

the gasket second transverse edge forming a first angle with the gasket first longitudinal edge, the first angle being an acute angle;

the gasket second transverse edge forming a second angle with the gasket second longitudinal edge; and, a strip of film extending over the four-sided opening and adhered to the gasket to form said gasket seal.

8. The gasket seal of claim 7, wherein said film is a polyester film.

9. The gasket seal of claim 7, wherein the first angle is about 30 degrees.

10. The gasket seal of claim 7, wherein the second angle is about 30 degrees.

11. The gasket seal of claim 7, wherein the first angle is about 22 degrees.

12. The gasket seal of claim 7, wherein the second angle is about 22 degrees.

13. A remanufactured laser printer toner cartridge comprising:

a hopper section containing laser printer toner and having an opening adapted to permit transfer of toner from the hopper section during printing operation;

a roller section operatively connected to the hopper section;

a gasket seal positioned over the opening;

the gasket seal comprising:

a gasket having an opening, positioned over the hopper section opening and adhered to the hopper section;

the gasket opening having a first edge, a second edge and a third edge;

the gasket first edge forming a first angle with the gasket third edge, the first angle being an acute angle;

the gasket second edge forming a second angle with the gasket third edge; and, a strip of film extending over the opening and adhered to the gasket.

14. The remanufactured cartridge of claim 13, wherein said film is a polyester film.

15. The remanufactured cartridge of claim 13, wherein the first angle is about 30 degrees.

16. The remanufactured cartridge of claim 13, wherein the second angle is about 30 degrees.

17. The remanufactured cartridge of claim 13, wherein the first angle is about 22 degrees.

18. The remanufactured cartridge of claim 13, wherein the second angle is about 22 degrees.

* * * * *